US005156095A

United States Patent [19]

Hansbaek et al.

[11] Patent Number: 5,156,095

[45] Date of Patent: Oct. 20, 1992

[54] TABLE HAVING ADDITIONAL EXTENDIBLE AND RETRACTABLE LEAVES

[75] Inventors: Per Hansbaek, Hojbjerg; Wojtek D. Carstens, Horsens, both of Denmark

[73] Assignee: Skovby Mobelfabrik A/S, Galten, Denmark

[21] Appl. No.: 602,264

[22] PCT Filed: Apr. 26, 1989

[86] PCT No.: PCT/DK89/00099

§ 371 Date: Nov. 2, 1990

§ 102(e) Date: Nov. 2, 1990

[87] PCT Pub. No.: WO89/10710

PCT Pub. Date: Nov. 16, 1989

[30] Foreign Application Priority Data

May 3, 1988 [DK] Denmark ..... 2398/88

[51] Int. Cl.[5] ..... A47B 1/00

[52] U.S. Cl. ..... 108/66; 108/86

[58] Field of Search ..... 108/66, 65, 68, 71, 108/74, 84, 83, 86

[56] References Cited

U.S. PATENT DOCUMENTS

| | | | |
|---|---|---|---|
| 678,948 | 7/1901 | Estes . | |
| 1,384,925 | 7/1921 | Seiler | 100/66 |
| 1,547,685 | 7/1925 | Rhodes . | |
| 3,683,025 | 8/1972 | Sheldon | 108/66 X |
| 4,553,485 | 11/1985 | Lee | 108/86 |
| 4,714,025 | 12/1987 | Wallin et al. | 108/147 X |

FOREIGN PATENT DOCUMENTS

| | | | |
|---|---|---|---|
| 289089 | 12/1915 | Fed. Rep. of Germany . | |
| 2219693 | 10/1972 | Fed. Rep. of Germany . | |
| 2545160 | 4/1977 | Fed. Rep. of Germany | 108/66 |
| 3119606 | 12/1982 | Fed. Rep. of Germany | 108/84 |
| 3303670 | 7/1984 | Fed. Rep. of Germany . | |
| 394988 | 2/1909 | France | 108/66 |
| 2533426 | 3/1984 | France . | |
| 514312 | 12/1971 | Sweden . | |
| 6788 | of 1835 | United Kingdom | 108/66 |
| 30248 | of 1910 | United Kingdom | 108/65 |

*Primary Examiner*—Jose V. Chen

*Attorney, Agent, or Firm*—Scully, Scott, Murphy & Presser

[57] ABSTRACT

A table comprises table leaves (4, 5, 6,) displaceable between a first position, in which the table area is relatively small, and a second position, in which the table area is relatively large by insertion of additional leaves (10, 11, 12, and 13). The table leaves (4,5, 6,) are radially displaceable from a first position in which they abut one another substantially along radial planes extending from the central axis. The additional leaves (10, 11, 12, and 13) are mutually defined and hingedly interconnected along rims extending in the second position of the table leaves (4,5,6) substantially along straight lines between innermost points of each table leaf (4,5,6) and the innermost point of the adjacent table leaf (4,5,6). A storing chamber is situated centrally below the table in a centrally situated supporting column (2) for the storing of the additional leaves (10,11,12,13) when the table is not extended.

8 Claims, 5 Drawing Sheets

TABLE HAVING ADDITIONAL EXTENDIBLE AND RETRACTABLE LEAVES

TECHNICAL FIELD

The invention relates to a table comprising table leaves displaceable between a first position, in which the table area is relatively small, and a second position, in which the table area is relatively large because of an insertion of additional leaves, whereby the table leaves are displaceable in radial direction relative to a vertical central axis, said table leaves being shaped in such a manner that in the first position they abut one another substantially along radial planes extending from the central axis as well as at points adjacent said central axis, and whereby the additional leaves are mutually defined along rims extending in the second position of the table leaves substantially along straight lines between the innermost point of each table leaf adjacent the central axis and the innermost point of the adjacent table leaf.

BACKGROUND ART

U.S. Pat. No. 678,948 discloses a table of the above type comprising displaceable table leaves and additional leaves which can be inserted when the table area is to be extended. The extension of the table area involves often much work, and several loose additional leaves can be difficult to handle.

CH-PS No. 514,312 discloses a table comprising displaceable table leaves and a cross-shaped additional leaf, the arms of which comprise hingedly connected outermost leaf sections. By folding the outermost leaf sections onto the remaining portion of the cross-shaped additional leaf, the additional leaf is to be horizontally stored in a chamber below the table leaves. During the placing of the additional leaf between the table leaves, it can be difficult to adjust the additional leaf so as to be on a level with the table leaves.

DISCLOSURE OF INVENTION

The object of the invention is to provide a table allowing a relatively easy rearrangement of the table leaves between the two positions simultaneous with the additional leaves being easy both to insert when the table area is to be extended and to remove and store when they are not necessary.

The table according to the invention is characterized in that the additional leaves are hingedly interconnected along their mutually defining rims, and that a vertically extending storing chamber is situated centrally below the table for the storing of the additional leaves when the table is not extended.

As a result a table is provided where the particular shape of the displaceable table leaves renders it possible to manufacture the additional leaves interconnected by means of hinges so that said additional leaves can be folded up and removed as one unit, said table leaves being stored in the storing chamber below the tabletop. In this manner the vertically extending storing chamber receives the additional leaves in a folded condition in which the leaf members—which in use in the extended table extend radially outwards between the table leaves—extend substantially vertically upwards within said storing chamber. The central position of the storing chamber has the effect that it is very easy for one person to place the additional leaves between the table leaves, and no difficulties are involved in vertically adjusting said additional leaves as said additional leaves can be placed directly on carrying means below the table leaves. The tabletop according to the invention may easily be provided with an attractive appearance both in the first and in the second position.

According to the invention the table leaves may cooperate with an underlying turning plate, the turning of which causes the radial displacement of the table leaves between the two positions, whereby said displacement of all the leaves is particularly easy and can be carried out simultaneously.

According to the invention the table leaves may be situated atop a carrying plate provided with radially extending dovetailed grooves, each dovetailed groove co-operating with a correspondingly shaped, radially extending sectional means secured to the bottom side of each table leaf, and a radially extending, through slot may be provided in the carrying plate in the bottom of each dovetailed groove, a protruding pin extending through said slot from the associated table leaf and engaging a corresponding guide in the turning plate pivotally mounted below the carrying plate. In this manner the guiding of the table leaves is particularly simple, and the table leaves can be secured in any position during their displacement at the same time as the displacement is initiated by means of the turning plate by way of simple means.

According to the invention it is particularly preferred that each of the guides in the turning plate extends along portions of a helical track, and that the guides are symmetrically shaped with respect to rotation relative to the vertical central axis of the table.

Furthermore according to the invention the storing chamber may comprise an upward opening which is opened by the displacement of the table leaves into the second position, both the carrying plate and the turning plate comprising a centrally located opening allowing passage of the additional leaves, whereby the additional leaves are easily situated in and removed from said storing chamber.

Moreover according to the invention biasing means may be provided between the additional leaves and the wall portions of the storing chamber, said biasing means subjecting the additional leaves to a biasing force in a direction out of the storing chamber when said additional leaves are stored therein, and in a direction towards the interior of the storing chamber when said additional leaves are situated between the table leaves in the second position thereof. As a result the handling of the additional leaves in and out of the storing chamber is particularly easy.

In addition according to the invention the centrally located leaf of the additional leaves may comprise radially projecting members, which when the table is used engage vertically extending guides in the wall of the storing chamber during the displacement of the additional leaves therein, and the biasing means may comprise a plurality of helical springs, where one end of each spring is connected to one of the radially projecting members on the central additional leaf, while the opposite end of the spring is connected to the wall of the storing chamber adjacent the corresponding vertical guide in the area about the center of the guide when seen in the longitudinal direction of said guide. In this manner the additional leaves are guided and displaced in a simple manner in the storing chamber.

According to the invention it is particularly advantageous when the turning plate is activated by an electric motor. Correspondingly the additional leaves can be activated in an advantageous manner by an electric motor.

Finally according to the invention the electric motors moving the turning plate and the additional leaves may be automatically activatable in succession depending on the motor which is to be activated first for initiating the displacement between the two positions of the table, whereby the change between the two positions is particularly easy.

BRIEF DESCRIPTION OF DRAWINGS

The invention is described in greater detail below with reference to the accompanying drawing, in which.

BEST MODE FOR CARRYING OUT THE INVENTION

Figure 1:
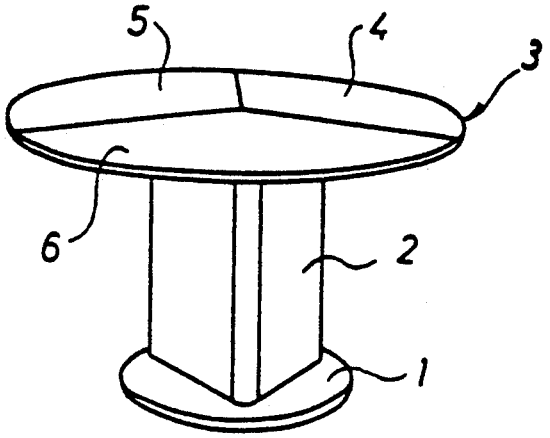
FIG. 1 is a perspective view of a preferred embodiment of a table according to the invention with three displaceable table leaves arranged in a first position where the table area is relatively small, FIG. 2 the embodiment of FIG. 1, but where parts have been cut out for the sake of clarity and where the table leaves are slightly displaced relative to one another, FIG. 3 the embodiment of FIGS. 1 and 2, but where the table leaves are arranged in a second position where the table area can be relatively large by this insertion of additional leaves, said additional leaves being shown on their way up from a storing chamber centrally located below the table surface.

The table of FIGS. 1–4 comprises a base 1. A supporting column 2 is centrally situated on the base 1 and comprises at the top a table leaf system provided with the general reference numeral 3. The table leaf system comprises three table leaves 4, 5, and 6 mounted in a mutually displaceable manner in radial direction about a vertical central axis in the table. The table leaves are of the same size and shape, and when seen from the top they appear as sectors of a circle.

Figure 2:
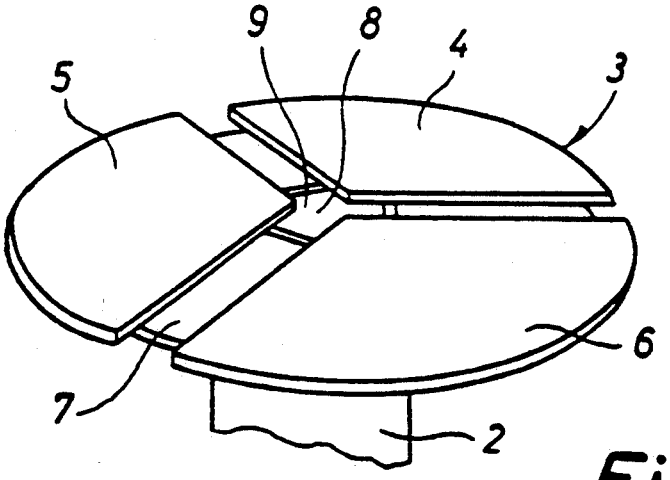
Figure 4:
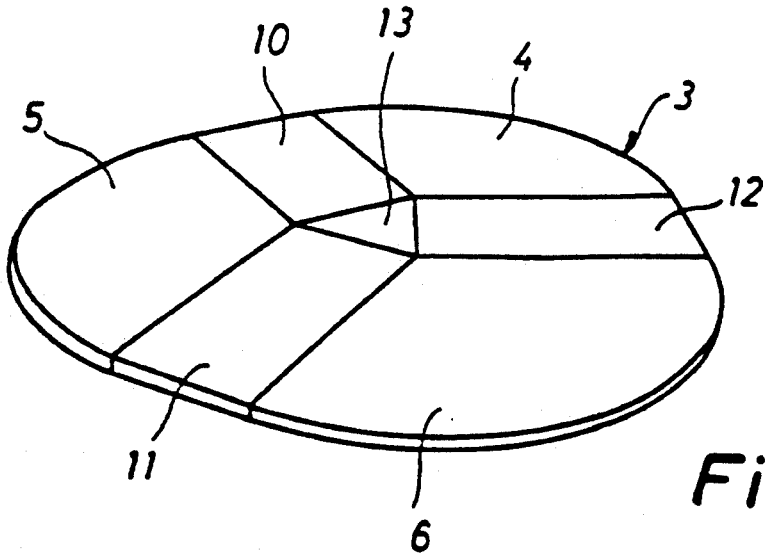
FIG. 4 is a perspective view of the table surface with the additional leaves arranged between the table leaves in the second position.

The table leaves rest on a carrying plate 7 inwardly defining an opening 8, cf. inter alia FIG. 2. The opening 8 opens into a storing chamber 9 inside the supporting column 2 for the storing of additional leaves 10, 11, 12, and 13. The additional leaves are to be inserted between the table leaves when said table leaves are spaced farthest from one another. FIG. 1 illustrates the table leaves 4, 5, and 6 in a first position, where the table area is relatively small. FIG. 4 illustrates a second position of the table leaves where the table area may be made relatively large by an insertion of the additional leaves 10, 11, 12, and 13.

Figure 3:
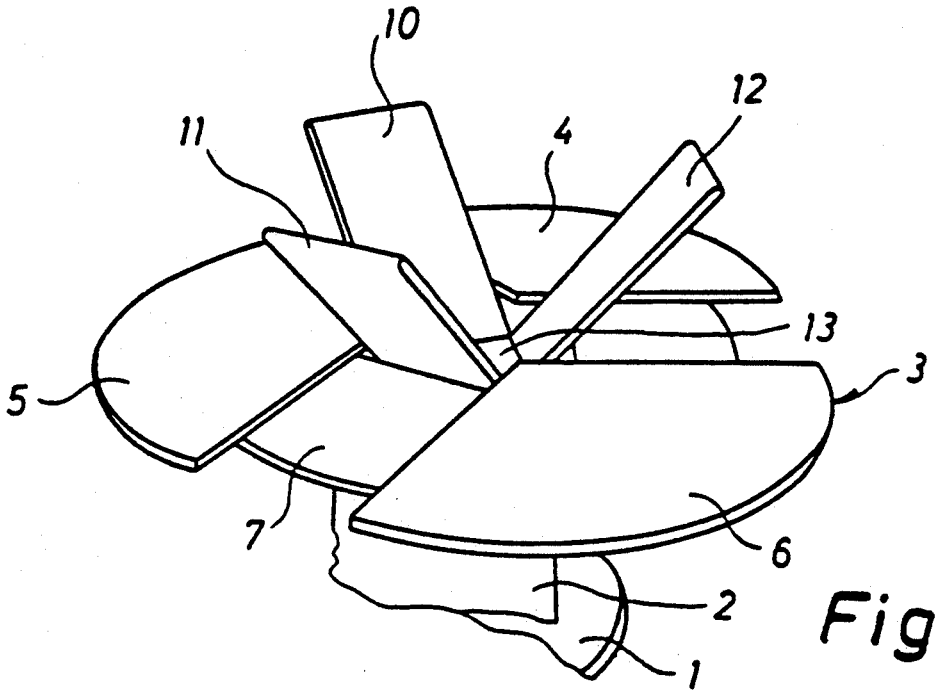
Figure 5:
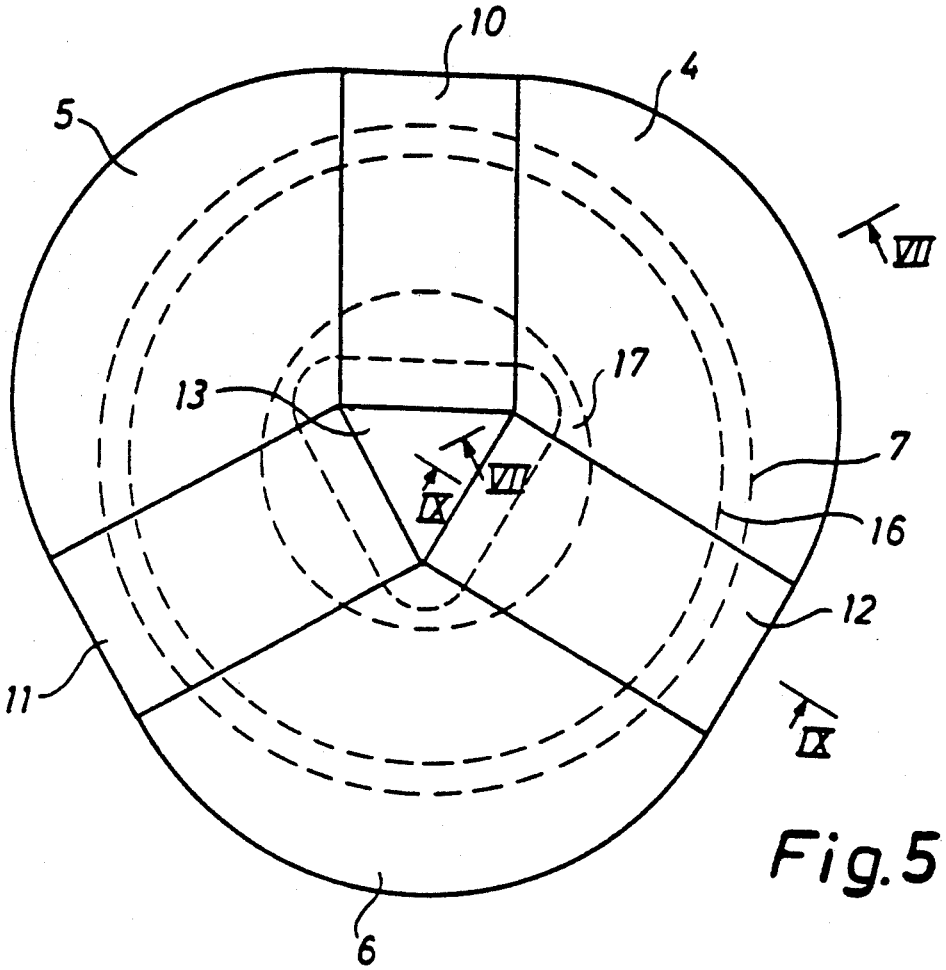
FIG. 5 is a top view of the table surface of FIG. 4, where the underlying parts are indicated by dotted lines.
Figure 7:
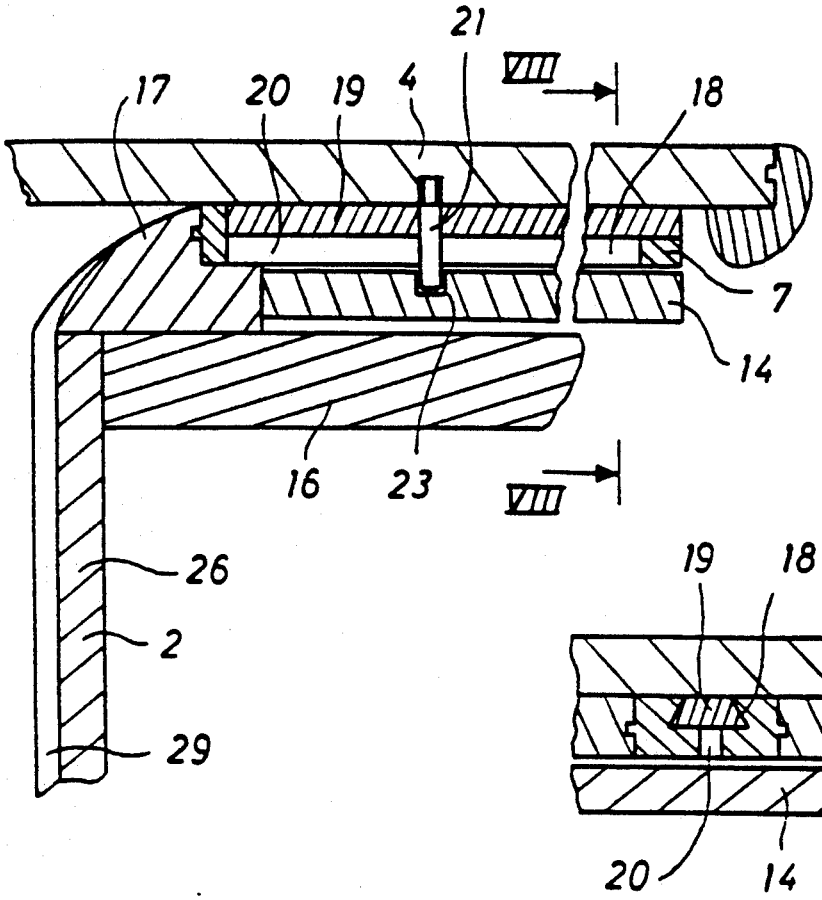
FIG. 7 is a sectional view taken along the line VII—VII of FIG. 5, but where the lower portion of the table has been removed for the sake of clarity.
Figure 8:
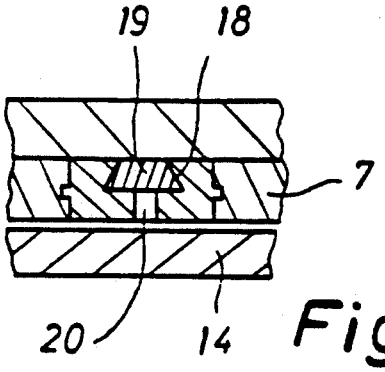
FIG. 8 is a sectional view taken along the line VIII—VIII of FIG. 7.

As illustrated in particular in FIGS. 3 and 4, there are four additional leaves, viz. a centrally located central leaf 13 shaped as an isosceles triangle when seen from the top with the corners closely abutting the innermost corners of the table leaves 4, 5, and 6 in the second position thereof. The remaining three additional leaves are all shaped as right-angled rectangles and abut their respective side of the centrally located leaf 13. The rectangular additional leaves 10–12 are hinged in a manner not shown in detail to the centrally located leaf 12 along the sides thereof with the effect that said rectangular additional leaves can be folded up, cf. FIG. 3, relative to the centrally located leaf 13 so as to be displaced downwards into the storing chamber 9. The hinges used are of a conventional type being countersunk in the abutting leaf rims in such a manner that they are almost invisible when the additional leaves 10–13 are inserted between the table leaves 4, 5, and 6 in the second position thereof, cf. FIG. 4. FIGS. 5–9 illustrate an annular turning plate 14 pivotally mounted below the carrying plate 7, which is shown seen from the top in FIG. 5 and sectionally in FIGS. 7–9. The turning plate 14 rests on a supporting plate 16 by means of wheels 15 mounted at regular intervals. Like the carrying plate 7, the supporting plate 16 is fixedly connected to the supporting column 2 by means not shown in greater details. The inner outline of the carrying plate 7 is indicated by means of dotted lines in FIG. 5, and as illustrated in FIGS. 7 and 8 it abuts a rim portion 17 defining the opening of the storing chamber 9. As also indicated in FIG. 5, the rim portion 17 is inwardly shaped substantially as an isosceles triangle with rounded corners and outwardly as a circle.

A dovetailed groove 18 is shaped in the carrying plate 7 centrally below each table leaf 4, 5, and 6, cf. FIGS. 7 and 8. The dovetailed groove extends radially relative to the central axis of the table and is adapted to receive a correspondingly shaped dovetailed guiding rib 19. One dovetailed guiding rib 19 is secured on each table leaf 4, 5, and 6 in such a manner that the displacement of said table leaves is guided by the ribs 19 engaging the dovetailed grooves 18 in the carrying plate 7. A through slot 20 extends centrally below and along the dovetailed groove 18. The slot 20 allows passage of a vertically downwardly projecting pin 21, such a pin also being secured in each table leaf 4, 5, and 6. The downwardly projecting pins 21 are secured in the associated table leaves 4, 5, and 6 for instance by means of threads. The pins 21 engage their respective guide 22, 23, and 24 below the carrying plate 7, said guides being shaped along their respective helical lines in the turning plate 14 below the carrying plate 7, cf. FIG. 6. A turning of the turning plate 14 about the axis of the table activates the displacement of the table leaves 4, 5, and 6 in radial direction outwardly or inwardly depending on the turning direction of the turning plate 14 and as a consequence of the engagement of the pins 21 with the guides 22, 23, and 24.

Figure 9:
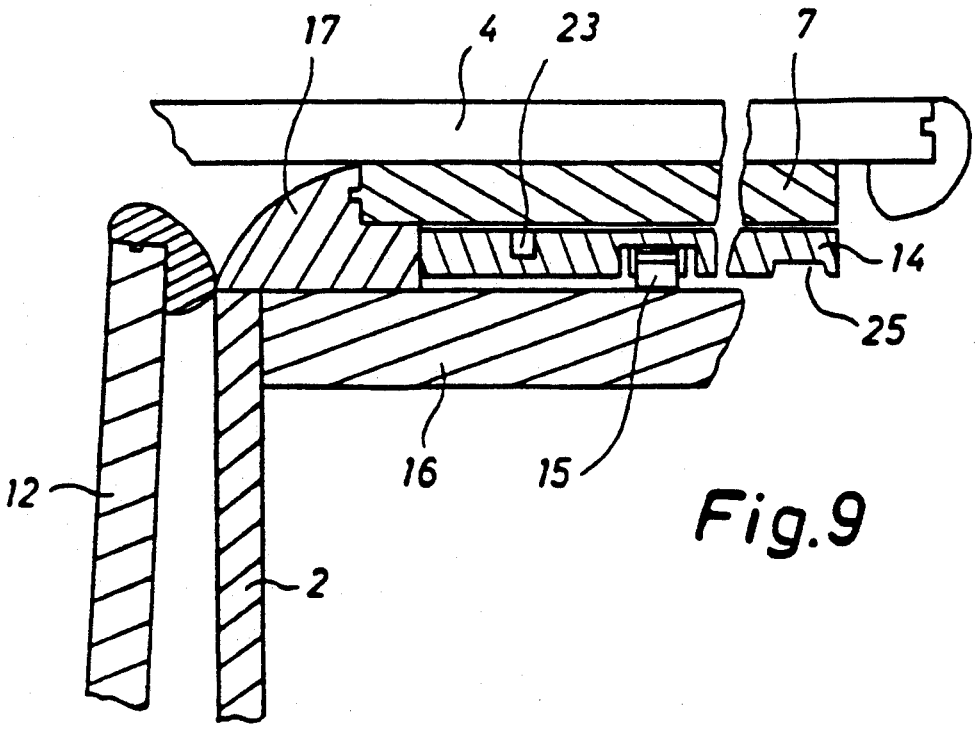
FIG. 9 is a sectional view taken along the line IX—IX of FIG. 5, but where the table leaves are arranged in the first position and the additional leaves are stored in the storing chamber, portions of the table being removed for the sake of clarity.

As illustrated in FIG. 9 a recess 25 is provided on the bottom side of the turning plate 14, said recess enabling a manual handling when the turning plate 14 is to be turned. The recess 25 may, if desired, be shaped along the entire edge of the bottom side of the turning plate 14.

Figure 6:
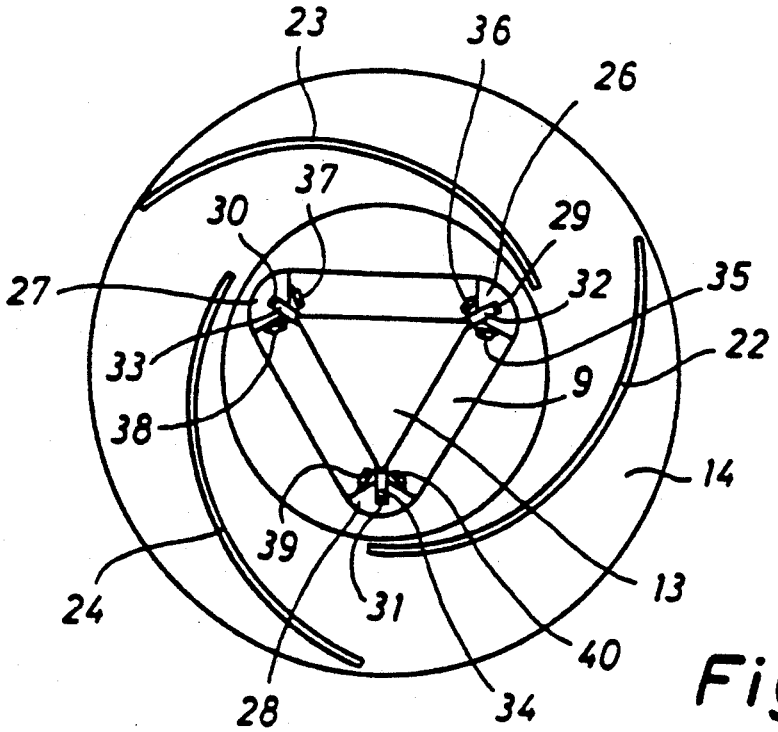
FIG. 6 is a top view of the table surface of FIG. 5, but where the table leaves and the additional leaves protruding radially between said table leaves as well as a subjacent carrying plate have been removed for the sake of clarity in such a manner that a turning plate for the displacement of the table leaves is shown from the top about the opening into the subjacent storing chamber receiving the additional leaves, the centrally located additional leaf being shown from the top.

As shown especially in FIG. 6, a substantially vertically extending corner member 26, 27, and 28, respectively, is provided in each corner of the storing chamber 9. Each corner member comprises at the side facing inwards a vertically extending guide 29, 30, and 31 facing radially inward, each guide receiving a radially protruding pin 32, 33, and 34 extending from the bottom side of the centrally located leaf 13 of the additional leaves 10–13. The pins are only illustrated in FIG. 6 and may be lists secured on the bottom side of the central leaf 13. As indicated in FIG. 6, helical springs 35, 36; 37, 38 and 39, 40, respectively are mounted between the corner members 26, 27, and 28 in the storing chamber 9 and the associated pins 32, 33, and 34 on the central leaf 13. The mounting location of the springs 35–40 on the corner members is almost at the center thereof when seen in the vertically extending, longitudinal direction thereof. When stored in the storing chamber the additional leaves 10–13 are consequently subjected to a biasing force in a direction out of the storing chamber, whereas they are subjected to a biasing force in a direction into the storing chamber when they are inserted between the table leaves 4, 5, and 6 in the second position thereof. In this manner the movement in and out of the storing chamber is facilitated, and the movement can be manually handled relatively easily by one person. A suitable placing of the mounting of the springs 35–40 on the corner members 26, 27, and 28 ensure that the biasing forces effecting the displacement of the additional leaves 10–13 out of the storing chamber are discontinued at the moment the weight of the rectangular additional leaves 10, 11, and 1 can take over the effect of the springs and thereby almost automatically lift said additional leaves out of the storing chamber.

The above table functions in the following manner. When the table is to be rearranged relative to the first position of FIG. 1, the turing plate 14 is turned a short distance clockwise when seen from the top until the table leaves 4, 5, and 6 are arranged in the second position shown in FIG. 2 as a consequence of the pins 21 engaging the guides 22, 23, and 24 in the turning plate 14. Subsequently, the additional leaves 10–13 are allowed to pass out of the storing chamber optionally while the rectangular additional leaves 10, 11, and 12 are subjected to a slight pull. Then the additional leaves are guided into their positions between the table leaves 4, 5, and 6 and optionally locked therebetween by means of mutually engaging pins and cavities not shown and a turning backwards of the turning plate 14 a short distance. When the additional leaves 10, 11, and 12 are to be removed again, their optional locking connection with the table leaves 4, 5, and 6 is at first disconnected whereafter the rectangular additional leaves 10, 11, and 12 are lifted upwards at their free ends until the springs 35–40 can take over the driving movement in a direction into the interior of the storing chamber 9. The additional leaves are moved downwards—optionally while being subjected to a slight pressure—to a level below the table leaves 4, 5, and 6, whereafter said table leaves are moved towards one another by turning the turning plate 14 counterclockwise compared to FIG. 6.

The table can be made of substantially any suitable type of wood and in any suitable manner, whereby some members can be assembled as indicated by mans of groove and spring connections or by means of screw connections not shown.

The invention has been described with reference to preferred embodiment. Many modifications can, however, be carried out without thereby deviating from the scope of the invention. The number of table leaves can for instance differ from the three leaves shown, and the number of additional leaves can be adjusted accordingly. Furthermore, the outer shape of the table leaves and the additional leaves can be varied as desired.

Figure 10:
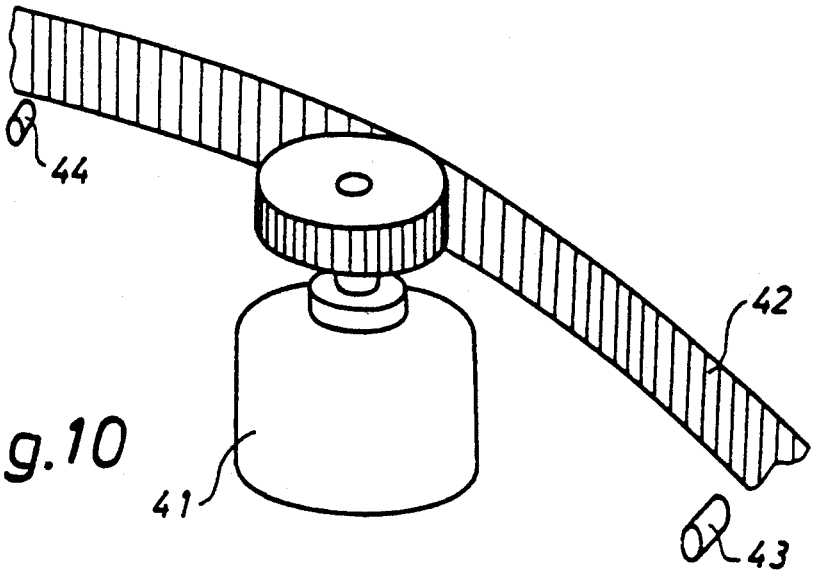
FIG. 10 is a diagrammatic view of means for activating the turning plate by means of an electric motor.
Figure 11:
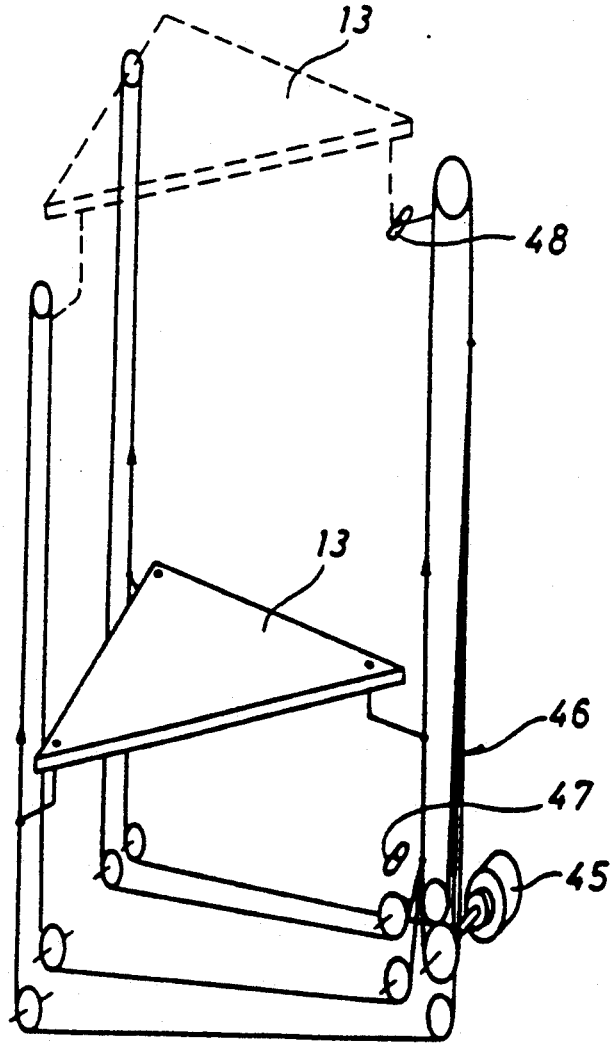
FIG 11 is a diagrammatic, perspective view of means for moving the additional leaves in and out of the storing chamber by means of an electric motor.

If desired, the table can also be constructed such that the above displacement from the first to the second position are carried out automatically by activating suitably arranged electric motors. FIGS. 10 and 11 illustrate such arrangements where FIG. 10 illustrates an electric motor 41 activating a curved rack 42—mounted in a manner not described in greater details—along the inner periphery of the turning plate 14. Suitably located sensors 43 and 44 stop the electric motor when the table leaves 4, 5, and 6 have reached the desired position. The sensors 43 and 44 can simultaneously be adapted to activate a second electric motor 45, cf. FIG. 11. The second electric motor activates a cord drive indicated by the general reference numeral 46. The cord drive is adapted to move the central leaf 13 of the additional leaves 10–13 by means of suitably situated pulleys in such a manner that said central leaf reciprocates vertically, the extreme positions of the central leaf 13 being detected by sensors 47 and 48. Depending on which motor 41 or 45 is to be activated first for initiating the rearrangement of the table, the sensors 43, 44, 47, and 48 can be adapted to activate the other electric motor 41 or 45 when the initially activated motor has arranged the associated, connected parts of the table in the desired position.

We claim:

1. A table formed substantially symmetrically about a vertical central axis and comprising table leaves displaceable between a first position, in which a surface area of the table is relatively small, and a second position, in which the surface area of the table is relatively large because of an insertion of additional leaves, the table leaves (4, 5 and 6) being displaceable in a radial direction relative to the vertical central axis by cooperating with an underlying turning plate (14), the turning of which causes the radial displacement of the table leaves (4, 5 and 6) between the first position and the second position, said table leaves being shaped in such a manner that in the first position they abut one another substantially along radial planes extending from the central axis as well as at points adjacent said central axis, and whereby the additional leaves are mutually defined along rims extending in the second position of the table leaves substantially along straight lines between the innermost point of each table leaf adjacent the central axis and the innermost point of the adjacent table leaf, characterised in that the additional leaves (10, 11, 12 and 13) comprise a central leaf (13) and several outer leaves (10, 11 and 1) which abut the central leaf on each straight rim of the central leaf and are hingedly interconnected at said abutting planes, said additional leaves cooperating with biasing means (35–40), said biasing means being disposed between the additional leaves (10, 11, 12 and 13) and at last one wall portion of a vertically extending storing chamber (9), said biasing means subjecting the additional leaves (10, 11, 12 and 13) to a biasing force in a direction out of the storing chamber (9) when said additional leaves are stored therein, and in a direction towards an interior of the storing chamber (9) when said additional leaves are situated between the table leaves (4, 5 and 6) in the second position thereof, said storing chamber being centrally located within a supporting column for the table and below the surface area of the table for the substantially vertical storing of the additional leaves when the table is in a retracted condition.

2. A table as claimed in claim 1, characterised in that the table leaves (4, 5, and 6) are situated atop a carrying plate (7) provided with radially extending dovetailed grooves (18), each dovetailed groove co-operating with a correspondingly shaped, radially extending sectional means (19) secured to a bottom side of each table leaf (4, 5, and 6) each provided with a downwardly protruding pin, and that a radially extending, through slot (20) is provided in the carrying plate (7) in a bottom of each dovetailed groove 918), said protruding pin (21) extending through said slot from the associated table leaf (4, 5, and 6) and engaging a corresponding guide (22, 23, and 24) in the turning plate (14) pivotally mounted below the carrying plate.

3. A table as claimed in claim 2, characterised in that each of the guides (22, 23, and 24) in the turning plate (14) extends along portions of a helical track, and that the guides (22, 23, and 24) are symmetrically shaped with respect to rotation relative to the vertical central axis of the table.

4. A table as claimed in claim 1, characterised in that the storing chamber (9) comprises an upward opening (8) which is opened by the displacement of the table leaves (4, 5, and 6) into the second position, both a carrying plate (7) and the turning plate (14) comprising a centrally located opening (8) allowing passage of the additional leaves (10, 11, 12, and 13).

5. A table as claimed in claim 1, characterised in that the central leaf of the additional leaves (10, 11, 12, and 13) comprises radially projecting members (32, 33, and 34), which when the table is used engage vertically extending guides (29, 30, and 31) in each wall of the storing chamber (9) during the displacement of the additional leaves (10, 11, 12, and 13), and that the biasing means (35–40) comprises a plurality of helical springs, where one end of each spring is connected to one of the radially projecting members (32, 33, and 34) on the central leaf (13), while the opposite end of the spring is connected to a wall of the storing chamber adjacent a corresponding vertical guide (29, 30, 31) in the area about a center of the guide (29, 30, and 31) when seen in the longitudinal direction of said guide.

6. A table as claimed in claim 1, characterised in that the turning plate (14) is activated by an electric motor (41).

7. A table as claimed in claim 1, characterised in that the additional leaves (10, 11, 12, and 13) are activated by an electric motor (45).

8. A table as claimed in claim 5, 6 or 7, characterised in that the electric motors (41, 45) moving the turning plate (14) and the additional leaves (10, 11, 12, and 13) are automatically activatable in succession depending on the motor which is to be activated first for initiating the displacement between the two positions of the table.

* * * * *

UNITED STATES PATENT AND TRADEMARK OFFICE

CERTIFICATE OF CORRECTION

PATENT NO. : 5,156,095

DATED : October 20, 1992

INVENTOR(S) : Per Hansbaek, et al.

It is certified that error appears in the above-identified patent and that said Letters Patent is hereby corrected as shown below:

Column 5, line 44: "10, 11 and 1" should read as --10, 11 and 12--

Column 6, line 67, Claim 1: "10, 11 and 1" should read as --10, 11 and 12--

Signed and Sealed this

Nineteenth Day of October, 1993

Bruce Lehman

*Attest:*

BRUCE LEHMAN

*Attesting Officer*

*Commissioner of Patents and Trademarks*